US009865218B2

(12) United States Patent
Kim et al.

(10) Patent No.: US 9,865,218 B2
(45) Date of Patent: Jan. 9, 2018

(54) DISPLAY DEVICE

(71) Applicant: Samsung Display Co. Ltd., Yongin (KR)

(72) Inventors: Ji Sun Kim, Seoul (KR); Won Sik Oh, Seoul (KR); Yeong Keun Kwon, Yongin-si (KR); Young Wan Seo, Suwon-si (KR); Young Soo Yoon, Seoul (KR); Chong Chul Chai, Seoul (KR)

(73) Assignee: SAMSUNG DISPLAY CO. LTD., Gyeonggi-Do (KR)

( * ) Notice: Subject to any disclaimer, the term of this patent is extended or adjusted under 35 U.S.C. 154(b) by 276 days.

(21) Appl. No.: 14/642,389

(22) Filed: Mar. 9, 2015

(65) Prior Publication Data

US 2016/0078836 A1 Mar. 17, 2016

(30) Foreign Application Priority Data

Sep. 15, 2014 (KR) ..... 10-2014-0122198

(51) Int. Cl.
*G09G 3/36* (2006.01)

(52) U.S. Cl.
CPC ..... *G09G 3/3688* (2013.01); *G09G 3/3611* (2013.01); *G09G 3/3614* (2013.01); *G09G 2300/0426* (2013.01); *G09G 2310/0297* (2013.01); *G09G 2310/08* (2013.01); *G09G 2330/021* (2013.01)

(58) Field of Classification Search
None
See application file for complete search history.

(56) References Cited

U.S. PATENT DOCUMENTS 7,400,306 B2 7/2008 Hu
7,714,826 B2 * 5/2010 Jang ..... G09G 3/3688 345/100
8,217,886 B2 7/2012 Lan et al.
(Continued)

FOREIGN PATENT DOCUMENTS

KR 1020060124085 12/2006
KR 1020080000361 1/2008
KR 1020080094419 10/2008

OTHER PUBLICATIONS

Masao Moriguchi, et al., "Gate driver and data switching circuit integrated LCD panel by high performance bottom gate microcrystalline Si TFT.", Dig. IDW, Miyazaki, 2009, p. 253-256.

*Primary Examiner* — Christopher Kohlman
(74) *Attorney, Agent, or Firm* — Cantor Colburn LLP

(57) ABSTRACT

A display device includes pixels arranged in a matrix form, gate lines extending in a first direction; data lines extending in a second direction, first and second unit pixel columns, each defined by adjacent data lines and the pixels connected thereto, first and second channels which transmit data signals to each of the first and second unit pixel columns, and a line selector which connects the first and second channels to the data lines and provides data voltages to the data lines in response to control signals, where a pixel connected to a first gate line is connected to a data line at a side thereof, a pixel connected to a second gate line is connected to a data line at the other side thereof, and each of the first and second channels is connected to a data line of each of the first and second unit pixel columns.

9 Claims, 14 Drawing Sheets

(56) References Cited

U.S. PATENT DOCUMENTS

| | | | | |
|---|---|---|---|---|
| 2008/0278466 | A1* | 11/2008 | Joo | G09G 3/3614 345/205 |
| 2009/0207104 | A1 | 8/2009 | Lee | |
| 2010/0164913 | A1* | 7/2010 | Lin | G09G 3/3688 345/205 |
| 2011/0175858 | A1 | 7/2011 | Lee et al. | |
| 2012/0019500 | A1 | 1/2012 | Hwang et al. | |
| 2013/0222216 | A1* | 8/2013 | Park | G09G 3/3614 345/55 |
| 2014/0078187 | A1* | 3/2014 | Choi | G09G 3/00 345/690 |
| 2014/0198135 | A1* | 7/2014 | Eom | G09G 3/3275 345/690 |

* cited by examiner

FIG. 11

| | | | | | | | | | | | |
|---|---|---|---|---|---|---|---|---|---|---|---|
| 2 | 1 | 2 | 1 | 2 | 1 | 2 | 1 | 2 | 1 | 2 | 1 |
| 2 | 1 | 2 | 1 | 2 | 1 | 2 | 1 | 2 | 1 | 2 | 1 |
| 1 | 2 | 1 | 2 | 1 | 2 | 1 | 2 | 1 | 2 | 1 | 2 |
| 1 | 2 | 1 | 2 | 1 | 2 | 1 | 2 | 1 | 2 | 1 | 2 |
| 2 | 1 | 2 | 1 | 2 | 1 | 2 | 1 | 2 | 1 | 2 | 1 |
| 2 | 1 | 2 | 1 | 2 | 1 | 2 | 1 | 2 | 1 | 2 | 1 |

DISPLAY DEVICE

This application claims priority to Korean Patent Application No. 10-2014-0122198 filed on Sep. 15, 2014, and all the benefits accruing therefrom under 35 U.S.C. §119, the contents of which in its entirety is herein incorporated by reference.

BACKGROUND

1. Field

Exemplary embodiments of the invention relate to a display device, and more particularly, to a display device in which a difference in effective charging time is reduced.

2. Description of the Related Art

A liquid crystal display ("LCD") may display an image corresponding to a video signal by adjusting light transmittance of liquid crystals thereof based on the video signal. The LCD typically includes an LCD panel having liquid crystal cells arranged in an active matrix and a plurality of driving circuits for driving the LCD panel. The LCD may further include a plurality of data lines and a plurality of gate lines, which intersect one another on the active matrix LCD panel, and a plurality of pixel driving thin-film transistors ("TFT"s) disposed at the intersections of the data lines and the gate lines. The driving circuits of the LCD may include a data driving circuit for supplying data to the data lines of the LCD panel and a gate driving circuit for supplying scan pulses to the LCD panel. The driving circuits may further include a demultiplexer installed between the data driving circuit and the data lines to distribute an output of a single data driving circuit to a number of data lines. Since the demultiplexer reduces the number of outputs of the data driving circuit, the data driving circuit may be simplified, and the number of data input terminals of the LCD panel may be reduced.

In such an LCD, when an electric field in one direction is applied to a liquid crystal layer for a long time, a degradation phenomenon may occur. To prevent such a degradation phenomenon, the polarity of a data voltage with respect to a common voltage may be inverted on a frame-by-frame basis, on a row or column-by-row or column basis, or on a pixel-by-pixel basis. In high-speed driving, column inversion is most widely utilized. The column inversion is to change the polarity of a data voltage flowing through the same data line on a frame-by-frame basis. Since the data voltage is inverted once in each frame, power consumption may be reduced by such a column inversion.

SUMMARY

In a liquid crystal display ("LCD") that operates based on a column inversion, a coupling defect and a stripe defect may occur due to the column inversion. The coupling defect is a phenomenon in which upper and lower parts of an LCD panel assembly show different luminances because a data voltage of the same polarity is continuously applied during one frame due to parasitic capacitance generated by the overlap between data lines and pixel electrodes. In particular, a vertical crosstalk phenomenon may occur. For example, when a box having a higher gray value than a background is displayed in the middle of the background having a low gray level, portions above and below the box may have different gray values from the background. The stripe defect is a phenomenon in which a stripe is formed when data voltages of the same polarity are applied in a vertical direction and when there is a difference between a positive data voltage and a negative data voltage.

The coupling defect and the stripe defect may be caused by structural limitations of the demultiplexer in which a difference in charging rate may occur due to a difference in effective charging time.

Exemplary embodiments of the invention provide a display device configured to reduce a stripe defect.

According to an exemplary embodiment of the invention, a display device includes a plurality of pixels arranged substantially in a matrix form, a plurality of gate lines extending substantially in a first direction, a plurality of data lines extending substantially in a second direction, a unit pixel column defined by a predetermined number of data lines and the pixels connected to the predetermined number of data lines, first and second channels which transmits data signals to the unit pixel column, first and second unit pixel rows, each defined by a predetermined number of gate lines and the pixels connected to the predetermined number of gate lines, and a line selector which connects the first and second channels to the predetermined number of data lines and provides data voltages to the predetermined number of data lines in response to a plurality of control signals, where each pixel in the first unit pixel row is connected to a data line located at a first side thereof, and each pixel in the second unit pixel row is connected to a data line located at a second side thereof.

According to another exemplary embodiment of the invention, a display device includes a plurality of pixels arranged substantially in a matrix form, a plurality of gate lines extending substantially in a first direction, a plurality of data lines extending substantially in a second direction, first and second unit pixel columns, each defined by a predetermined number of data lines and the pixels connected the predetermined number of data lines, first and second channels which transmit data signals to each of the first and second unit pixel columns, and a line selector which connects the first and second channels to the data lines of the first and second unit pixel columns and provides data voltages respectively to the data lines of the first and second unit pixel columns in response to a plurality of control signals, where a pixel connected to a first gate line is connected to a data line located at a first side thereof, a pixel connected to a second gate line is connected to a data line located at a second side thereof, and each of the first channel and the second channel is connected to a data line of each of the first unit pixel column and the second unit pixel column.

According to another exemplary embodiment of the invention, a display device includes a plurality of pixels arranged substantially in a matrix form, a plurality of gate lines extending substantially in a first direction, a plurality of data lines extending substantially in a second direction, first and second unit pixel columns, each defined by a predetermined number of data lines and the pixels connected to the predetermined number of data lines, first and second channels which transmit data signals to each of the first and second unit pixel columns, first and second unit pixel rows, each defined by a predetermined number of gate lines and the pixels connected to the predetermined number of gate lines, and a line selector which connects the first and second channels to the data lines of the first and second unit pixel columns and providing data voltages respectively to the data lines of the first and second unit pixel columns in response to a plurality of control signals, where each pixel of the first unit pixel row is connected to a data line located at a first side thereof, each pixel of the second unit pixel row is connected to a data line located at a second side thereof, and each of the first channel and the second channel is connected to a data line of each of the first unit pixel column and the second unit pixel column.

BRIEF DESCRIPTION OF THE DRAWINGS

The above and other features of the invention will become more apparent by describing in detail exemplary embodiments thereof with reference to the attached drawings, in which:

FIG. 11 illustrates the luminance-based pixel arrangement of an alternative exemplary embodiment of the LCD according to the invention.

DETAILED DESCRIPTION

Figure 1:
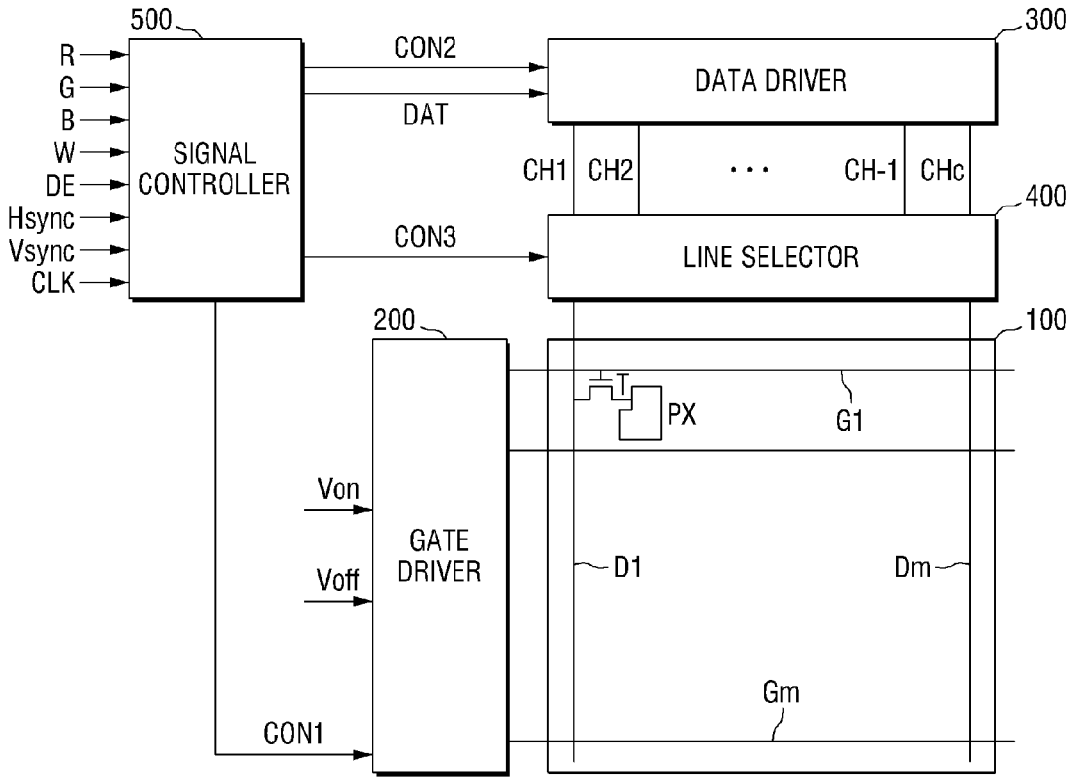
FIG. 1 is a block diagram showing an exemplary embodiment of a liquid crystal display ("LCD") according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on," or "connected to" another element or layer, it can be directly on or connected to the other element or layer or intervening elements or layers may be present. In contrast, when an element is referred to as being "directly on" or "directly connected to" another element or layer, there are no intervening elements or layers present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will hereinafter be described with reference to the attached drawings.

Figure 2:
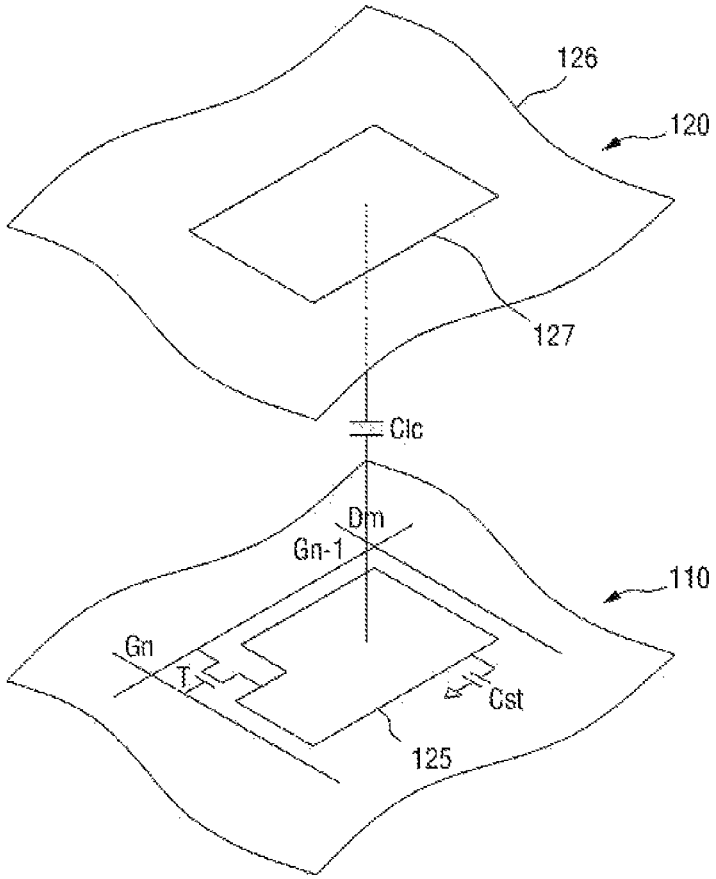
FIG. 2 is an equivalent circuit diagram showing a pixel of an exemplary embodiment of the LCD according to the invention.

FIG. 1 is a block diagram showing an exemplary embodiment of a liquid crystal display ("LCD") according to the invention. FIG. 2 is an equivalent circuit diagram of a pixel in an exemplary embodiment of the LCD.

Referring to FIG. 1, an exemplary embodiment of the LCD according to the invention may include an LCD panel 100, a gate driver 200 which is connected to the LCD panel 100, a data driver 300, a line selector 400 which is connected to the data driver 300 by a plurality of channels, and a signal controller 500 which controls the LCD panel 100, the gate driver 200, the data driver 300 and the line selector 400.

In an exemplary embodiment, as shown by an equivalent circuit diagram of FIG. 2, the LCD panel 100 may include a plurality of signal lines (G1 through Gn and D1 through Dm) and a plurality of pixels PX which are connected to the signal lines (G1 through Gn and D1 through Dm) and arranged substantially in a matrix form. Herein, m and n are natural numbers. In such an embodiment, referring to the structure of FIG. 2, the LCD panel 100 may include lower and upper panels 110 and 120 which face each other and a liquid crystal layer (not illustrated) which is interposed between the lower and upper panels 110 and 120.

The signal lines (G1 through Gn and D1 through Dm) may include a plurality of gate lines G1 through Gn which deliver gate signals and a plurality of data lines D1 through Dm which deliver data signals. The gate lines G1 through Gn may extend substantially in a first direction, e.g., a row direction, and may be substantially parallel to each other. The data lines D1 through Dm may extend substantially in a second direction, e.g., a column direction, and may be substantially parallel to each other.

In an exemplary embodiment, each pixel PX, for example, a pixel PX connected to an $n^{th}$ gate line Gn and an $m^{th}$ data line Dm, may include a thin-film transistor ("TFT") T which is connected to the signal lines Gn and Dm and a liquid crystal capacitor Clc and a storage capacitor Cst which are connected to the TFT T. In an alternative exemplary embodiment, the storage capacitor Cst may be omitted.

The TFT T may include a control terminal connected to the gate line Gn, an input terminal connected to the data line Dm, and an output terminal connected to the liquid crystal capacitor Clc and the storage capacitor Cst.

Two terminals of the liquid crystal capacitor Clc may be defined by a pixel electrode 125 of the lower panel 110 and a common electrode 126 of the upper display panel 120, respectively. The liquid crystal layer between the pixel and common electrodes 125 and 126 may function as a dielectric of the liquid crystal capacitor Clc. The pixel electrode 125 is connected to the TFT T. The common electrode 126 may be disposed to overlap an entire of a surface of the upper panel 120, and a common voltage Vcom is applied to the common electrode 126. In an alternative exemplary embodiment, the common electrode 126 may be disposed on the lower panel 110. In such an embodiment, at least one of the two electrodes 125 and 126 may be linear or bar-shaped.

In such an embodiment, the storage capacitor Cst supplements the liquid crystal capacitor Clc. The storage capacitor Cst may be defined by an overlapping portion of a signal line (not illustrated) and the pixel electrode 125, which are disposed on the lower panel 110, with an insulator interposed therebetween, and a predetermined voltage, such as the common voltage Vcom, may be applied to the signal line. In an alternative exemplary embodiment, the storage capacitor Cst may be defined by an overlapping portion of the pixel electrode 125 and a previous gate line, which is disposed immediately above the pixel electrode 125, with an insulator interposed therebetween.

Each pixel PX may display one of three primary colors (spatial division) or may alternately display the three primary colors at different times (time division) such that a spatial-temporal sum of the three primary colors produces a predetermined color. The three primary colors may be, for example, red (R), green (G) and blue (B). In an exemplary embodiment, each pixel PX may include a color filter 127 representing one of the three primary colors in a region of the upper panel 120 which corresponds to the pixel electrode 125 for the spatial division, as illustrated in FIG. 2. In an alternative exemplary embodiment, the color filter 127 may be disposed on or under the pixel electrode 125 of the lower panel 110.

In such an embodiment, a polarizer (not illustrated) which polarizes light may be attached to an outer surface of the LCD panel 100.

Referring back to FIG. 1, the gate driver 200 may be connected to the gate lines G1 through Gn of the LCD panel 100 and may transmit a gate signal having a voltage level corresponding to a gate-on voltage Von or a gate-off voltage Voff to the gate lines G1 through Gn.

The data driver 300 may be connected to the data lines D1 through Dm of the LCD panel 100. The data driver 300 may receive a data voltage from the signal controller 500 and apply the received data voltage to the data lines D1 through Dm as a data signal via the line selector 400.

The line selector 400 may distribute a data signal received from the data driver 300 to a plurality of data lines via a plurality of demultiplexers (not illustrated). The demultiplexers may include a plurality of TFTs and transmit the data signal to the data lines D1 through Dm at different times.

The signal controller 500 may control the gate driver 200, the data driver 300 and the line selector 400. The gate driver 200, the data driver 300, the line selector 400 or the signal controller 500 may be mounted directly on the LCD panel 100 in the form of a integrate circuit ("IC") chip. Alternatively, the gate driver 200, the data driver 300, the line selector 400 or the signal controller 500 may be mounted on a flexible printed circuit film (not illustrated) and then attached to the LCD panel 100 in the form of a tape carrier package ("TCP") or may be mounted on a separate printed circuit board (not illustrated). In an alternative exemplary embodiment, the gate driver 200, the data driver 300, the line selector 400 or the signal controller 500 may be integrated on the LCD panel 100 together with signal lines (e.g., the gate lines G1 through Gn and the data lines D1 through Dm) and switching devices (e.g., the TFTs T).

In an exemplary embodiment, the gate driver 200, the data driver 300, the line selector 400 or the signal controller 500 may be integrated as a single chip. In such an embodiment, at least one of the gate driver 200, the data driver 300, the line selector 400 and the signal controller 500 or at least one circuit device that forms the gate driver 200, the data driver 300, the line selector 400 or the signal controller 500 may be disposed outside the single chip.

In the operation of the LCD, the signal controller 500 may receive input image signals R, G and B and an input control signal for controlling the display of the input image signals R, G and B from an external graphics controller (not illustrated). In one exemplary embodiment, for example, the input control signal may include a vertical synchronization signal Vsync, a horizontal synchronization signal Hsync, a main clock CLK and a data enable signal DE.

The signal controller 500 processes the input image signals R, G and B based on operating conditions of the LCD panel 100 to generate digital image signals DAT, and generates a gate control signal CON1 and a data control signal CON2 based on the input image signals R, G and B and the input control signal. Then, the signal controller 500 transmits the gate control signal CON1 to the gate driver 200 and transmits the data control signal CON2 and the digital image signals DAT to the data driver 300.

The gate control signal CON1 may include a scan start signal for instructing the start of scanning and a clock signal for controlling the output timing of the gate-on voltage Von. The gate control signal CON1 may further include an output enable signal for limiting the duration of the gate-on voltage Von.

The data control signal CON2 may include a horizontal synchronization start signal for notifying the transmission start of image data for One row of pixels PX, a load signal for instructing the transmission of a data signal to the data lines D1 through Dm, and a data clock signal.

The data control signal CON2 may further include an inversion signal for inverting a voltage polarity of a data signal with respect to the common voltage Vcom. Hereinafter, "the voltage polarity of the data signal with respect to the common voltage Vcom" will be referred to as "the polarity of the data signal."

A line selection control signal CON3 may determine the order in which a data signal from the data driver 300 is transmitted to the data lines D1 through Dm. A TFT (not illustrated) included in the line selector 400 may be turned on by the line selection control signal CONT to provide the data signal to a data line connected to the TFT.

In response to the data control signal CON2 from the signal controller 500, the data driver 300 may receive the digital image signals DAT for one row of pixels PX, convert the digital image signals DAT into analog data signals by selecting a gray voltage corresponding to each of the digital image signals DAT, and transmit the analog data signals to a corresponding data line of the data lines D1 through Dm.

In response to the gate control signal CON1 from the signal controller 500, the gate driver 200 may apply the gate-on voltage Von to a gate line, thereby turning on TFTs T connected to the gate line. Then, the data signals transmitted to the data lines D1 through Dm may be delivered to corresponding pixels PX via the turned-on TFTs T.

A difference between a voltage of a data signal transmitted to a pixel PX and the common voltage Vcom may be a voltage charged in the liquid crystal capacitor Clc, that is, a pixel voltage. The arrangement of liquid crystal molecules may vary based on the magnitude of the pixel voltage, thereby changing the polarization of light passing through the liquid crystal layer. Such a change in polarization may be represented by a change in transmittance of light by the polarizer attached to the LCD panel 100.

Such a process described above may be repeated every horizontal period 1H, which is equal to one period of each of the horizontal synchronization signal Hsync and the data enable signal DE. In such an embodiment, the gate-on voltage Von may be sequentially applied to all gate lines G1 through Gn, and thus data signals may be transmitted to all pixels PX. Accordingly, the pixels PX may display an image of one frame.

When a frame ends, a next frame begins. In an exemplary embodiment, the state of the inversion signal transmitted to the data driver 300 may be controlled such that the polarity of a data signal transmitted to each pixel PX during a current frame becomes opposite to the polarity of the data signal transmitted to each pixel PX during a previous frame ("frame inversion"). In an exemplary embodiment, the polarity of the data signal flowing through one data line may be changed within a frame according to characteristics of the inversion signal ("line inversion"). In an alternative exemplary embodiment, data signals with different polarities may be transmitted to a row of pixels ("dot inversion").

The pixel arrangement of an exemplary embodiment of the LCD according to the invention will now be described in detail with reference to FIGS. 3 through 6.

Figure 3:
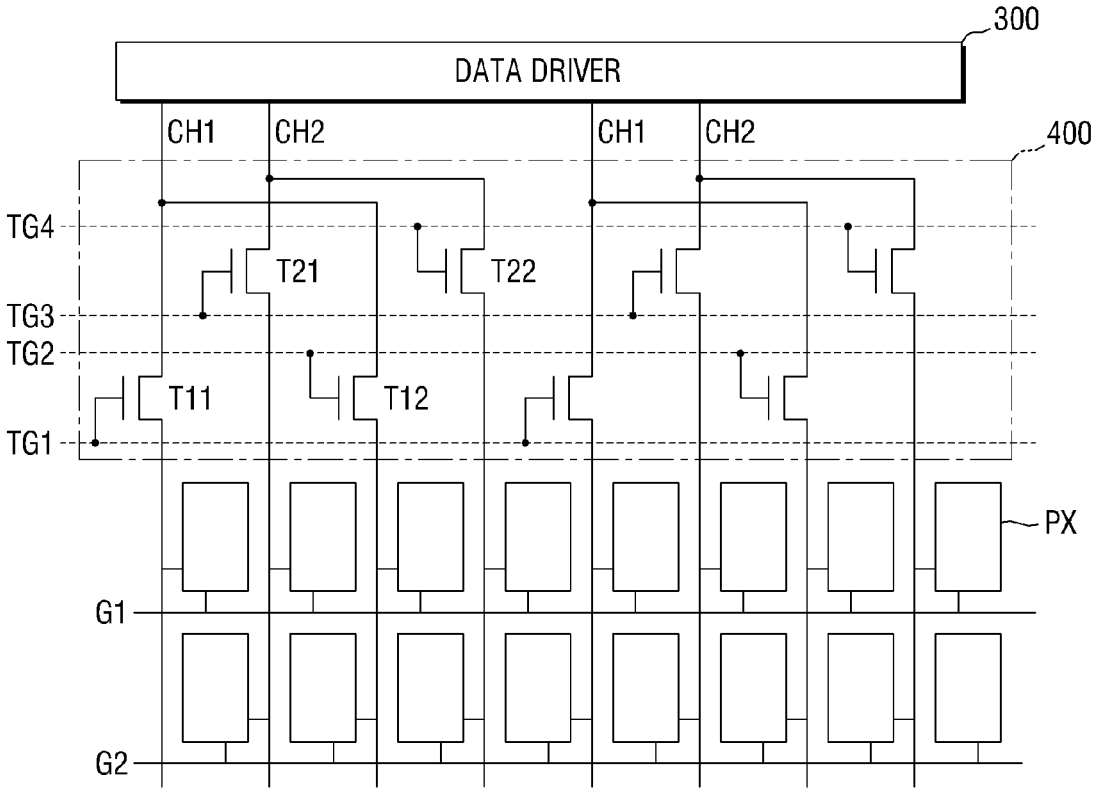
FIG. 3 illustrates a line selector and pixel arrangement of an exemplary embodiment of the LCD according to the invention.
Figure 4:
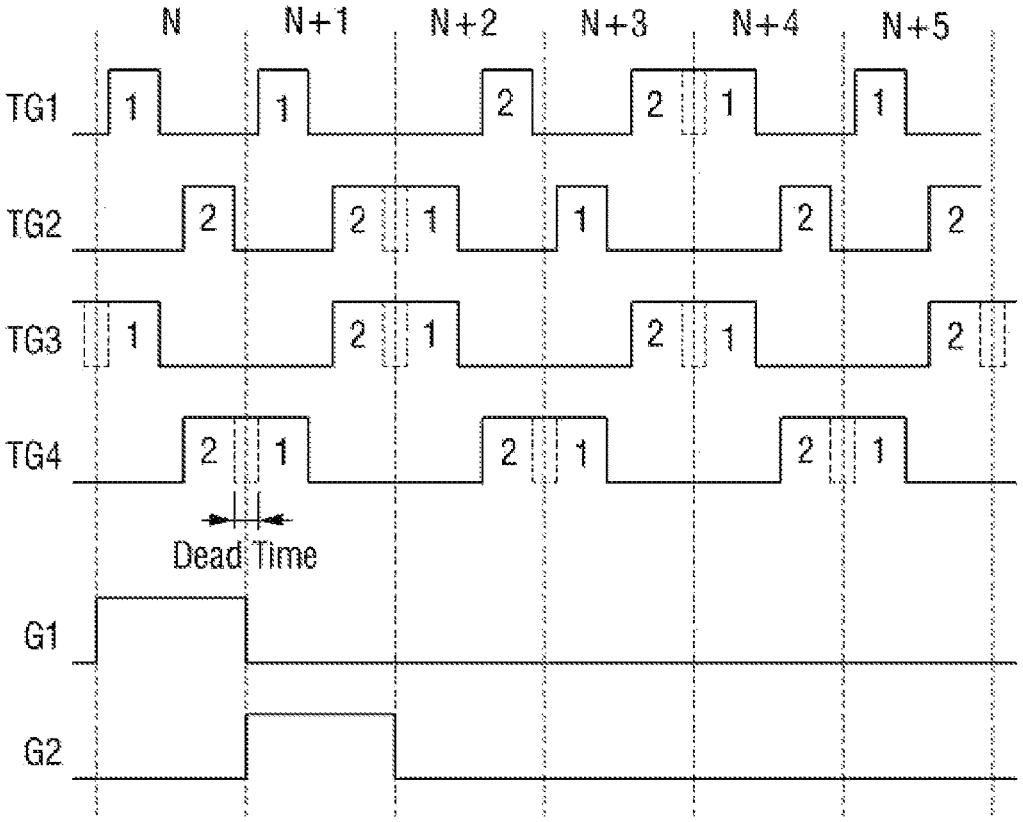
FIG. 4 is a timing diagram illustrating the driving order of an exemplary embodiment of the LCD according the invention.

FIG. 3 illustrates the line selector 400 and pixel arrangement of an exemplary embodiment of the LCD according to the invention. FIG. 4 is a timing diagram illustrating the driving order of an exemplary embodiment of the LCD according to the invention.

Referring to FIG. 3, in an exemplary embodiment, the data driver 300 of the LCD may be connected to a plurality of channels CH1 through CH4 to which data signals are transmitted. Different data signals may be transmitted to the channels CH1 through CH4, respectively.

In an exemplary embodiment, the line selector 400 may be disposed between the data driver 300 and the data lines D1 through Dm and may include first through fourth select transistors T11, T12, T21 and T22 for distributing data signals transmitted to the first and second channels CH1 and CH2 to four data lines. The first through fourth select transistors T11, T12, T21 and T22 may temporally divide data signals received through two channels and transmit the temporally divided data signals to four data lines in response to first through fourth select control signals TG1 through TG4, respectively. In such an embodiment, the four data lines may be defined as a unit pixel column.

In an exemplary embodiment, as described above, four data lines may be defined as a unit pixel column, but the invention is not limited thereto. In an alternative exemplary embodiment, a predetermined number of data lines, e.g., a bundle or group of data lines, among the data lines D1 to Dm may be defined as a unit pixel column. In such an embodiment, the predetermined number of data lines may be adjacent data lines to each other.

A pixel driving transistor (not illustrated) included in each pixel PX may transmit a data signal from a data line to a pixel electrode of a liquid crystal cell in response to a scan signal from a gate line. In such an embodiment, a gate electrode of the pixel driving transistor may be connected to the gate line, and a source electrode of the pixel driving transistor may be connected to the data line. In such an embodiment, a drain electrode of the pixel driving transistor may be connected to the pixel electrode of the liquid crystal cell.

Referring to FIG. 4, in an exemplary embodiment, the first through fourth selection control signals TG1 through TG4 may have a high-level voltage at different times. In such an embodiment, scan signals may sequentially have a high-level voltage.

A first scan signal g1 may have a high-level voltage (the gate-on voltage Von) during one horizontal time period 1H, which is the duration of a horizontal period of the scan signal, and have a low-level voltage after the one horizontal time period 1H.

A second scan signal g2 may be a scan signal shifted from the first scan signal g1 by one horizontal time period 1H.

Like the first scan signal g1, the second scan signal g2 may have the gate-on voltage Von during one horizontal time period 1H and have a low-level voltage after the one horizontal time period 1H.

In an exemplary embodiment, each of the first scan signal g1 and the second scan signal g2 may have one or more gate-on voltages Von during one frame. In such an embodiment, each of the first scan signal g1 and the second scan signal g2 may have a plurality of gate-on voltages Von during one frame.

Each of the first through fourth selection control signals TG1 through TG4 may have a high-level voltage (the gate-on voltage Von) in each horizontal period 1H of a scan signal. The duration of the gate-on voltage Von of each of the first through fourth selection control signals TG1 through TG4 may be a half or less than a half of one horizontal time period 1H of the scan signal.

Each of the first through fourth selection control signals TG1 through TG4 may have a first turn-on voltage 1 or a second turn-on voltage 2 depending on the time when it has a high-level voltage. Herein, the first turn-on voltage 1 refers to a turn-on voltage having a high level in a first half of a period section, and the second turn-on voltage 2 refers to a turn-on voltage having a high level in a second half after the first half of the period section.

In one exemplary embodiment, for example, the first selection control signal TG1 has the first turn-on voltage 1 in a first horizontal section N, the first turn-on voltage 1 in a second horizontal section N+1, the second turn-on voltage 2 in a third horizontal section N+2, the second turn-on voltage 2 in a fourth horizontal section N+3, the first turn-on voltage 1 in a fifth horizontal section N+4, and the first turn-on voltage 1 in a sixth horizontal section N+5, as shown in FIG. 4. Herein, a horizontal section may have a width corresponding to one horizontal time period 1H. In such an embodiment, where the first selection control signal TG1 is repeated every four horizontal periods, the period of the first selection control signal TG1 is 4H.

In one exemplary embodiment, for example, the second selection control signal TG2 has the second turn-on voltage 2 in the first horizontal section N, the second turn-on voltage 2 in the second horizontal section N+1, the first turn-on voltage 1 in the third horizontal section N+2, the first turn-on voltage 1 in the fourth horizontal section N+3, the second turn-on voltage 2 in the fifth horizontal section N+4, and the second turn-on voltage 2 in the sixth horizontal section N+5, as shown in FIG. 4. In such an embodiment, where the second selection control signal TG2 is also repeated every four horizontal periods, the period of the second selection control signal TG2 is 4H.

In one exemplary embodiment, for example, the third selection control signal TG3 has the first turn-on voltage 1 in the first horizontal section N, the second turn-on voltage 2 in the second horizontal section N+1, the first turn-on voltage 1 in the third horizontal section N+2, the second turn-on voltage 2 in the fourth horizontal section N+3, the first turn-on voltage 1 in the fifth horizontal section N+4, and the second turn-on voltage 2 in the sixth horizontal section N+5, as shown in FIG. 4. In such an embodiment, where the third selection control signal TG3 is repeated every two horizontal periods, the period of the third selection control signal TG3 is 2H.

In one exemplary embodiment, for example, the fourth selection control signal TG4 has the second turn-on voltage 2 in the first horizontal section N, the first turn-on voltage 1 in the second horizontal section N+1, the second turn-on voltage 2 in the third horizontal section N+2, the first turn-on voltage 1 in the fourth horizontal section N+3, the second turn-on voltage 2 in the fifth horizontal section N+4, and the first turn-on voltage 1 in the sixth horizontal section N+5, as shown in FIG. 4. In such an embodiment, where the fourth selection control signal TG4 is repeated every two horizontal periods, the period of the fourth selection control signal TG4 is 2H.

When one of the first through fourth selection control signals TG1 through T4 sequentially has the first turn-on voltage 1 and the second turn-on voltage 2, or the second turn-on voltage 2 and the first turn-on voltage 1, the one of the first through fourth selection control signals TG1 through T4 may maintain a high-level voltage for one horizontal time period 1H. In such an embodiment, a high-level voltage may be maintained during a dead time between the first turn-on voltage 1 and the second turn-on voltage 2, as shown in FIG. 4. However, the high-level voltage may not affect the operations of the first through fourth selection transistors T11, T12, T21 and T22.

Figure 5:
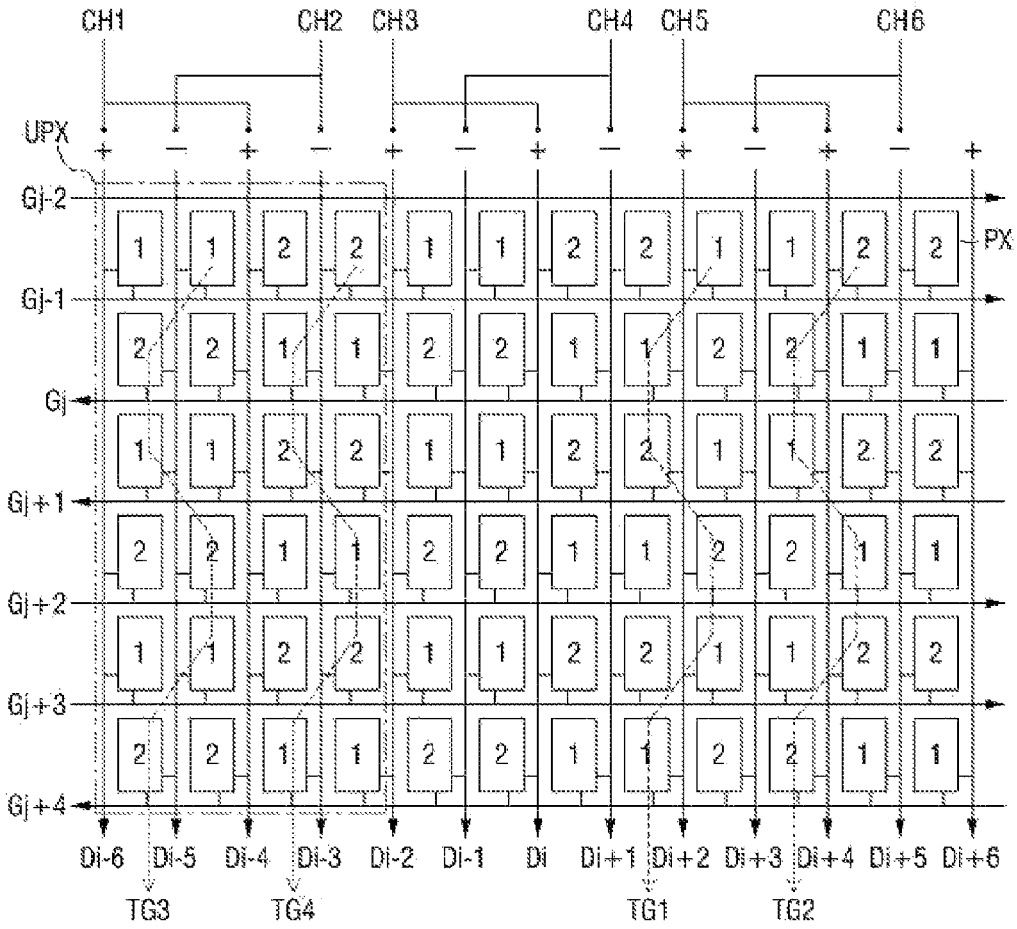
FIG. 5 illustrates the turn-on timing of each pixel of an exemplary embodiment of the LCD of according to the invention.
Figure 6:
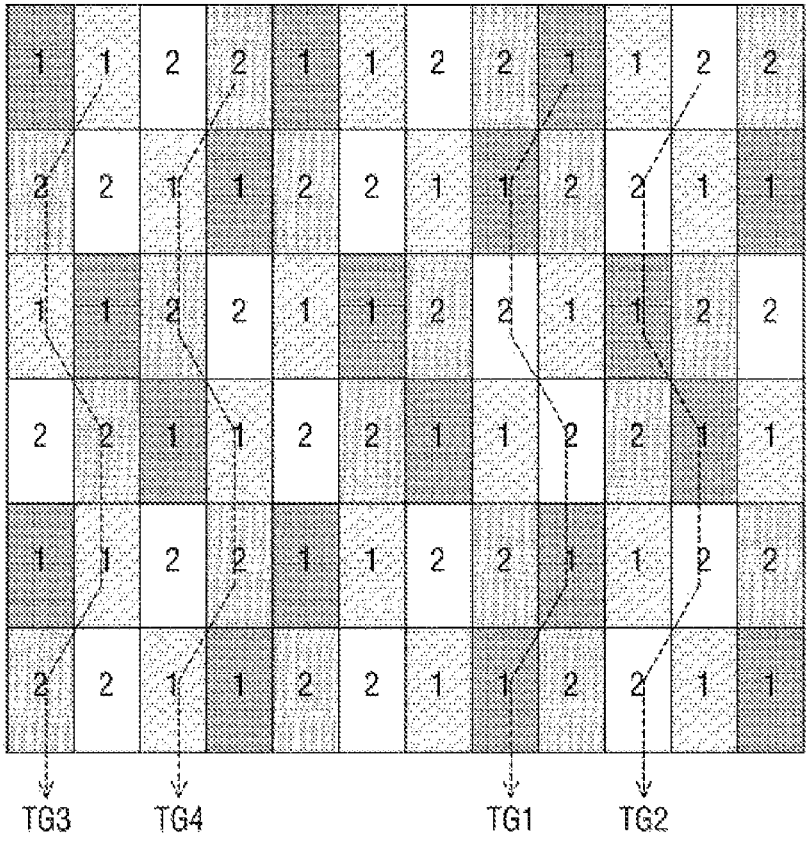
FIG. 6 illustrates the luminance-based pixel arrangement of an exemplary embodiment of the LCD of according to the invention.

FIG. 5 illustrates the turn-on timing of each pixel of an exemplary embodiment of the LCD of according to the invention. FIG. 6 illustrates the luminance-based pixel arrangement of an exemplary embodiment of the LCD of according to the invention.

FIG. 5 shows which data voltage corresponding to the first turn-on voltage 1 and the second turn-on voltage 2 is applied to each pixel of an exemplary embodiment of the LCD panel 100 and the polarity of a data voltage applied to each pixel.

Data signals provided by the data driver 300 may be transmitted to the line selector 400 via a plurality of channels CH1, CH2, CH3, . . . , and the line selector 400 may provide the data signals to the individual data lines D1 through Dm.

The LCD panel 100 may include unit pixels UPX, each defined by a plurality of pixels. A unit pixel UPX may include data lines connected to the first channel CH1 and the second channel CH2. A positive voltage may be applied to the first channel CH1, and a negative voltage may be applied to the second channel CH2.

In an exemplary embodiment, one of the data voltages corresponding to the first turn-on voltage 1 and the second turn-on voltage 2 may be applied to individual pixels at different times in response to the first through fourth selection control signals TG1 through TG4 provided by the line selector 400.

Pixels PX located relatively at the same position within corresponding unit pixels UPX may have the same polarity, and the pixels PX located at the same position in individual unit pixels UPX may receive data voltages based on a same one of the first turn-on voltage 1 and the second turn-on voltage 2. However, data signals transmitted through individual channels may be different from each other.

In FIG. 5, part of data lines and part of gate lines are shown for convenience of illustration. In an exemplary embodiment, the data driver 300 may perform column inversion as represented by polarities shown above the data lines in FIG. 5. In such an embodiment, where the data driver 300 performs the column inversion, a positive voltage and a negative voltage may alternate with each other, or the same polarity may be repeated twice. In one exemplary embodiment, for example, two polarities of a data voltage may alternate with each other to have a polarity sequence of '+, −, +, −, +, −, . . . ' (e.g., N×1 inversion), or the same polarity may be repeated twice and then inverted to have a polarity sequence of '+, +, −, −, +, +, −, −, +, +, . . . ' (e.g., N×2 inversion). In such an embodiment, each pixel PX is connected to the data line and the gate line via the TFT T thereof.

In an exemplary embodiment, each pixel PX is connected to a data line at a first side or a second side thereof. Herein, the first side and the second side may be opposite to each other, e.g., a right side and a left side. A row of pixels PX may be connected to a right or left data line thereof, and each pixel PX in a same column may be alternately connected to a right data line thereof and a left data line thereof, or each group of pixels PX in a same column may be alternately connected to a right data line and a left data line. Herein, a right data line or a left data line of a pixel means a data line at a right side or a left side of the pixel. For ease of description, a pixel row included in the LCD panel 100 and another pixel row adjacent to the pixel row in the column direction (e.g., a pixel row connected to a $j^{th}$ gate line Gj and a pixel row connected to a $(j+1)^{th}$ gate line Gj+1) may be defined as a unit pixel row. In one exemplary embodiment, for example, a unit pixel row may refer to a bundle of two adjacent pixel rows in the column direction. However, the invention is not limited thereto, and a bundle of three or more (e.g., four, six or eight) pixel rows may be defined as a unit pixel row in an alternative exemplary embodiment.

Each pixel PX included in a unit pixel row may be connected to a data line located in the same direction. In one exemplary embodiment, for example, individual pixels PX of a first unit pixel row may be connected to a right data line, that is, a data line located on a right side thereof, and individual pixels PX of a second unit pixel row may be connected to a left data line, that is, a data line located on a left side thereof. The first unit pixel row and the second unit pixel row may be arranged alternately with each other, and the same polarity may be repeated twice and then inverted to have a polarity sequence of '+, +, −, −, +, +, −, −, +, +, . . . '. Therefore, in such an embodiment, a stripe defect that may occur when a column of pixels PX have the same polarity is effectively prevented.

In such an embodiment, where the LCD has a demultiplexer structure, in which a difference in charging rate may occur, the first through fourth selection control signals TG1 through TG4 shown in FIG. 4 may be sequentially transmitted to pixels of a unit pixel column, starting with a pixel located on the left side of the unit pixel column. The first through fourth selection control signals TG1 through TG4 may be transmitted in the same order to each unit pixel column.

In an exemplary embodiment, a $(i+2)^{th}$ data line Di+2 may be connected to the first select transistor T11 to which the first selection control signal TG1 is transmitted. In such an embodiment, as shown in FIG. 5, while a gate signal transmitted to a first gate line in FIG. 5, that is, a $(j-1)^{th}$ gate line Gj−1, has a high level, the first turn-on voltage 1 is applied to the first select transistor T11 connected to the $(i+2)^{th}$ data line Di+2. Therefore, a pixel connected to the $(i+2)^{th}$ data line Di+2 and the first gate line Gj−1 may display an image corresponding to a data voltage applied thereto based on the first turn-on voltage 1. While a signal transmitted to a second gate line in FIG. 5, that is, a $j^{th}$ gate line Gj, has a high level, the first turn-on voltage 1 is applied to the first select transistor T11 connected to the $(i+2)^{th}$ data line Di+2. Therefore, a pixel connected to the $(i+2)^{th}$ data line Di+2 and the second gate line Gj may display an image corresponding to a data voltage applied thereto based on the first turn-on voltage 1. While a signal transmitted to a third gate line in FIG. 5, that is, a $(j+1)^{th}$ gate line Gj+1, has a high level, the second turn-on voltage 2 is applied to the first select transistor T11 connected to the $(i+2)^{th}$ data line Di+2. Therefore, a pixel connected to the $(i+2)^{th}$ data line Di+2 and the third gate line Gj+1 may display an image corresponding to a data voltage applied thereto based on the second turn-on voltage 2. While a signal transmitted to a fourth gate line in FIG. 5, that is, a $(j+2)^{th}$ gate line Gj+2, has a high level, the second turn-on voltage 2 is applied to the first select transistor T11 connected to the $(i+2)^{th}$ data line Di+2. Therefore, a pixel connected to the $(i+2)^{th}$ data line Di+2 and the fourth gate line Gj+2 may display an image corresponding to a data voltage applied thereto based on the second turn-on voltage 2. A turn-on voltage applied to the first select transistor T11 connected to the $(i+2)^{th}$ data line Di+2 in response to a signal transmitted to a fifth gate line in FIG. 5, that is, a $(j+3)^{th}$ gate line Gj+3 is the same as a turn-on voltage applied to the first select transistor T11 connected to the $(i+2)^{th}$ data line Di+2 in response to the signal transmitted to the first gate line Gj−1. Therefore, a data signal may be provided to an individual pixel connected to the fifth gate line Gj+3 in the same way that a data signal is provided to the pixel connected to the first gate line Gj−1.

In an exemplary embodiment, a $(i+4)^{th}$ data line Di+4 may be connected to the second select transistor T12 to which the second selection control signal TG2 is transmitted. In such an embodiment, as shown in FIG. 5, while a signal transmitted to the first gate line Gj−1 has a high level, the second turn-on voltage 2 is applied to the second select transistor T12 connected to the $(i+4)^{th}$ data line Di+4. Therefore, a pixel connected to the $(i+4)^{th}$ data line Di+4 and the first gate line Gj−1 may display an image corresponding to a data voltage applied thereto based on the second turn-on voltage 2. While a signal transmitted to the second gate line Gj has a high level, the second turn-on voltage 2 is applied to the second select transistor T12 connected to the $(i+4)^{th}$ data line Di+4. Therefore, a pixel connected to the $(i+4)^{th}$ data line Di+4 and the second gate line Gj may display an image corresponding to a data voltage applied thereto based on the second turn-on voltage 2. While a signal transmitted to the third gate line Gj+1 has a high level, the first turn-on voltage 1 is applied to the second select transistor T12 connected to the $(i+4)^{th}$ data line Di+4. Therefore, a pixel connected to the $(i+4)^{th}$ data line Di+4 and the third gate line Gj+1 may display an image corresponding to the first turn-on voltage 1. While a signal transmitted to the fourth gate line Gj+2 has a high level, the first turn-on voltage 1 is applied to the second select transistor T12 connected to the $(i+4)^{th}$ data line Di+4. Therefore, a pixel connected to the $(i+4)^{th}$ data line Di+4 and the fourth gate line Gj+2 may display an image corresponding to a data voltage applied thereto based on the first turn-on voltage 1. A turn-on voltage applied to the second select transistor T12 connected to the $(i+4)^{th}$ data line Di+4 in response to a signal transmitted to the fifth gate line Gj+3 is the same as a turn-on voltage applied to the second select transistor T12 connected to the $(i+4)^{th}$ data line Di+4 in response to the signal transmitted to the first gate line Gj−1. Therefore, a data signal can be provided to an individual pixel connected to the fifth gate line Gj+3 in the same way that a data signal is provided to the pixel connected to the first gate line Gj−1.

In such an embodiment, a $(i-5)^{th}$ data line Di−5 may be connected to the third select transistor T21 to which the third selection control signal TG3 is transmitted. In such an embodiment, as shown in FIG. 5, while a signal transmitted to the first gate line Gj−1 has a high level, the first turn-on voltage 1 is applied to the third select transistor T21 connected to the $(i-5)^{th}$ data line Di−5. Therefore, a pixel connected to the $(i-5)^{th}$ data line Di−5 and the first gate line Gj−1 may display an image corresponding to a data voltage applied thereto based on the first turn-on voltage 1. While a signal transmitted to the second gate line Gj has a high level, the second turn-on voltage 2 is applied to the third select transistor T21 connected to the $(i-5)^{th}$ data line Di−5. Therefore, a pixel connected to the $(i-5)^{th}$ data line Di−5 and the second gate line Gj may display an image corresponding to a data voltage applied thereto based on the second turn-on voltage 2. While a signal transmitted to the third gate line Gj+1 has a high level, the first turn-on voltage 1 is applied to the third select transistor T21 connected to the $(i-5)^{th}$ data line Di−5. Therefore, a pixel connected to the $(i-5)^{th}$ data line Di−5 and the third gate line Gj+1 may display an image corresponding to a data voltage applied thereto based on the first turn-on voltage 1. While a signal transmitted to the fourth gate line Gj+2 has a high level, the second turn-on voltage 2 is applied to the third select transistor T21 connected to the $(i-5)^{th}$ data line Di−5. Therefore, a pixel connected to the $(i-5)^{th}$ data line Di−5 and the fourth gate line Gj+2 may display an image corresponding to a data voltage applied thereto based on the second turn-on voltage 2. A turn-on voltage applied to the third select transistor T21 connected to the $(i-5)^{th}$ data line Di−5 in response to a signal transmitted to the fifth gate line Gj+3 is the same as a turn-on voltage applied to the third select transistor T21 connected to the $(i-5)^{th}$ data line Di−5 in response to the signal transmitted to the first gate line Gj−1. Therefore, a data signal can be provided to an individual pixel connected to the fifth gate line Gj+3 in the same way that a data signal is provided to the pixel connected to the first gate line Gj−1.

In such an embodiment, a $(i-3)^{th}$ data line Di−3 may be connected to the fourth select transistor T22 to which the fourth selection control signal TG4 is transmitted. In such an embodiment, as shown in FIG. 5, while a signal transmitted to the first gate line Gj−1 has a high level, the second turn-on voltage 2 is applied to the fourth select transistor T22 connected to the $(i-3)^{th}$ data line Di−3. Therefore, a pixel connected to the $(i-3)^{th}$ data line Di−3 and the first gate line Gj−1 may display an image corresponding to a data voltage applied thereto based on the second turn-on voltage 2. While a signal transmitted to the second gate line Gj has a high level, the first turn-on voltage 1 is applied to the fourth select transistor T22 connected to the $(i-3)^{th}$ data line Di−3. Therefore, a pixel connected to the $(i-3)^{th}$ data line Di−3 and the second gate line Gj may display an image corresponding to a data voltage applied thereto based on the first turn-on voltage 1. While a signal transmitted to the third gate line Gj+1 has a high level, the second turn-on voltage 2 is applied to the fourth select transistor T22 connected to the $(i-3)^{th}$ data line Di−3. Therefore, a pixel connected to the $(i-3)^{th}$ data line Di−3 and the third gate line Gj+1 may display an image corresponding to a data voltage applied thereto based on the second turn-on voltage 2. While a signal transmitted to the fourth gate line Gj+2 has a high level, the first turn-on voltage 1 is applied to the fourth select transistor T22 connected to the $(i-3)^{th}$ data line Di−3. Therefore, a pixel connected to the $(i-3)^{th}$ data line Di−3 and the fourth gate line Gj+2 may display an image corresponding to a data voltage applied thereto based on the first turn-on voltage 1. A turn-on voltage applied to the fourth select transistor T22 connected to the $(i-3)^{th}$ data line Di−3 in response to a signal transmitted to the fifth gate line Gj+3 is the same as a turn-on voltage applied to the fourth select transistor T22 connected to the $(i-3)^{th}$ data line Di−3 in response to the signal transmitted to the first gate line Gj−1. Therefore, a data signal can be provided to an individual pixel connected to the fifth gate line Gj+3 in the same way that a data signal is provided to the pixel connected to the first gate line Gj−1.

In such an embodiment, where a data voltage is applied to each individual pixel as described above, the luminance of each individual pixel may be determined as illustrated in FIG. 6.

Referring to FIG. 6, individual pixels having four types of luminance may be disposed on the LCD panel 100. In such an embodiment, the individual pixels may have four types of luminance due to the difference in the polarity of a data signal transmitted to each individual pixel and the charging rate of each individual pixel.

In an exemplary embodiment, as described above, a pixel to which a data voltage is applied based on the second turn-on voltage 2 has a lower charging rate than a pixel to which a data voltage is applied based on the first turn-on voltage 1 due to insufficient charging time. Therefore, the luminance of each individual pixel PX may vary due to the data voltage applied corresponding to the first turn-on voltage 1 or the second turn-on voltage 2. In such an embodiment, a difference between a positive voltage and the common voltage Vcom may be different from a difference between a negative voltage and the common voltage Vcom, such that a luminance difference may occur due to the polarity of a data signal transmitted to each individual pixel.

Therefore, four types of luminance may be generated, that is, a luminance when a pixel receives a data voltage having the positive voltage in response to the first turn-on voltage 1 applied, a luminance when a pixel receives a data voltage having the positive voltage in response to the second turn-on voltage 2, a luminance when a pixel receives a data voltage having the negative voltage in response to the first turn-on voltage 1, and a luminance when a pixel receives a data voltage having the negative voltage in response to the second turn-on voltage 2.

In an exemplary embodiment, as shown in FIG. 6, individual pixels having four different types of luminance are substantially evenly distributed over the LCD panel 100. In a LCD panel, a stripe defect may occur when pixels having the same luminance are repeatedly arranged in the same column or in adjacent columns. In an exemplary embodiment, the pixels are arranged based on luminance as illustrated in FIG. 6, such that the stripe defect may be substantially reduced.

Figure 7:
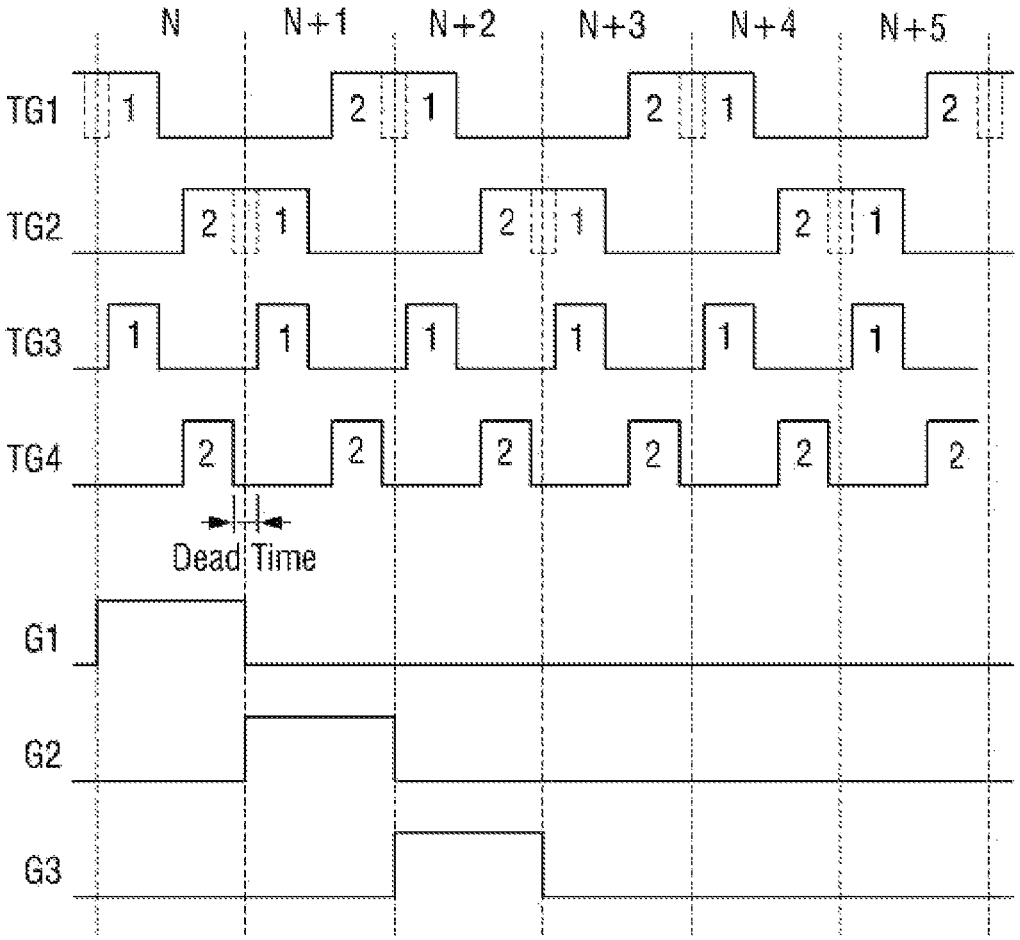
FIG. 7 is a timing diagram illustrating the driving order of an exemplary embodiment of an LCD according to the invention.
Figure 8:
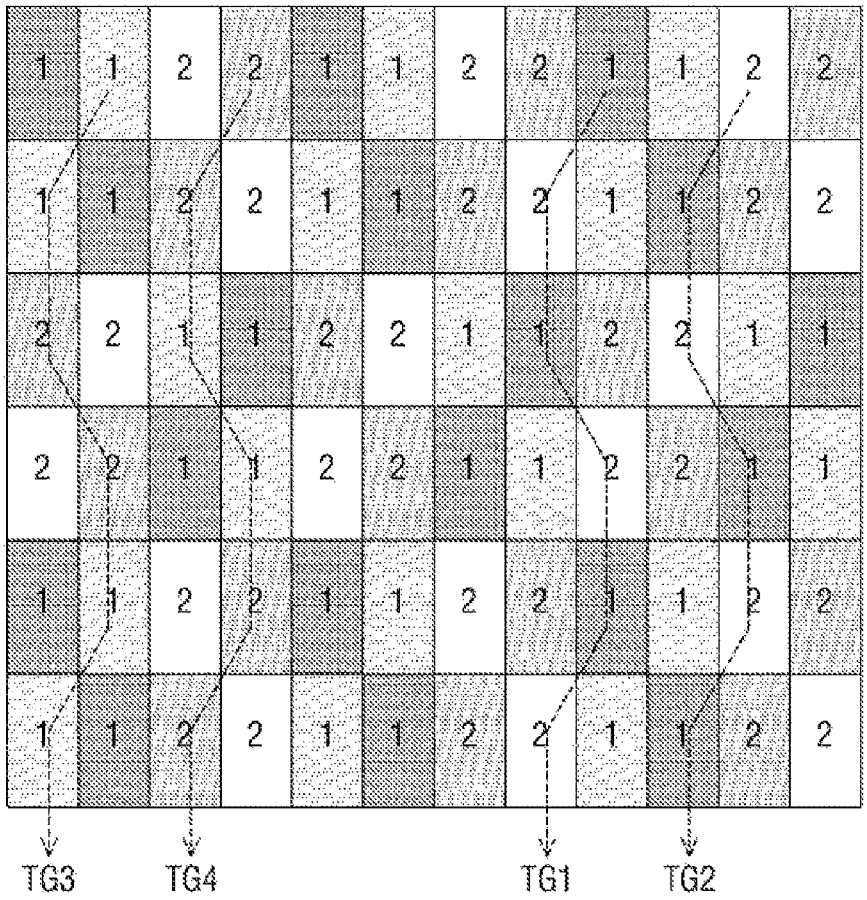
FIG. 8 illustrates the luminance-based pixel arrangement of an alternative exemplary embodiment of the LCD according to the invention.

FIG. 7 is a timing diagram illustrating the driving order of an alternative exemplary embodiment of an LCD according to the invention. FIG. 8 illustrates the luminance-based pixel arrangement of the LCD of FIG. 7.

The driving timing diagram shown in FIG. 7 is substantially the same as the driving timing diagram shown in FIG. 4, and any repetitive detailed description thereof will be omitted. Referring to FIG. 7, first through fourth selection control signals TG1 through TG4 may have a high-level voltage at different times. In such an embodiment, scan signals may sequentially have a high-level voltage.

In an exemplary embodiment, as shown in FIG. 7, each of first through third scan signals g1 through g3 may have a high-level voltage (a gate-on voltage Von) during one horizontal time period 1H and have a low-level voltage after the one horizontal time period 1H. In such an embodiment, the second scan signal g2 is a scan signal shifted from the first scan signal g1 by one horizontal time period 1H, and the third scan signal g3 is a scan signal shifted from the second scan signal g2 by one horizontal time period 1H.

Each of first through fourth selection control signals TG1 through TG4 may have a high-level voltage (the gate-on voltage Von) in each horizontal period 1H of a scan signal. The duration of the gate-on voltage Von of each of the first through fourth selection control signals TG1 through TG4 may be a half or less than a half of one horizontal time period 1H of the scan signal.

In an exemplary embodiment, as shown in FIG. 7, the first selection control signal TG1 has a first turn-on voltage 1 in a first horizontal section N, a second turn-on voltage 2 in a second horizontal section N+1, the first turn-on voltage 1 in a third horizontal section N+2, and the second turn-on voltage 2 in a fourth horizontal section N+3. In such an embodiment, where the first selection control signal TG1 is repeated every two horizontal periods, the period of the first selection control signal TG1 is 2H.

In such an embodiment, the second selection control signal TG2 has the second turn-on voltage 2 in the first horizontal section N, the first turn-on voltage 1 in the second horizontal section N+1, the second turn-on voltage 2 in the third horizontal section N+2, and the first turn-on voltage 1 in the fourth horizontal section N+3. In such an embodiment, where the second selection control signal TG2 is also repeated every two horizontal periods, the period of the second selection control signal TG2 is 2H.

In such an embodiment, the third selection control signal TG3 has the first turn-on voltage 1 in the first horizontal section N and the first turn-on voltage 2 in the second horizontal section N+1. In such an embodiment, where the third selection control signal TG3 is repeated every horizontal period, the period of the third selection control signal TG3 is 1H.

In such an embodiment, the fourth selection control signal TG4 has the second turn-on voltage 2 in the first horizontal section N and the second turn-on voltage 2 in the second horizontal section N+1. In such an embodiment, where the fourth selection control signal TG4 is repeated every horizontal period, the period of the fourth selection control signal TG4 is 1H.

Referring to FIG. 8, in such an embodiment, four types of luminance may be displayed by the pixels, that is, a luminance when a pixel receives a data voltage having a positive voltage in response to the first turn-on voltage 1, a luminance when a pixel receives a data voltage having the positive voltage in response to the second turn-on voltage 2, a luminance when a pixel receives a data voltage having a negative voltage in response to the first turn-on voltage 1, and a luminance when a pixel receives a data voltage having the negative voltage in response to the second turn-on voltage 2.

In such an embodiment, as shown in FIG. 8, individual pixels having four different types of luminance are substantially evenly distributed over an LCD panel 100. In an LCD panel, a stripe defect may occur when pixels having the same luminance are repeatedly arranged in the same column or in adjacent columns. In such an embodiment, where pixels are arranged based on luminance as illustrated in FIG. 8, such a stripe defect may be substantially reduced.

Figure 9:
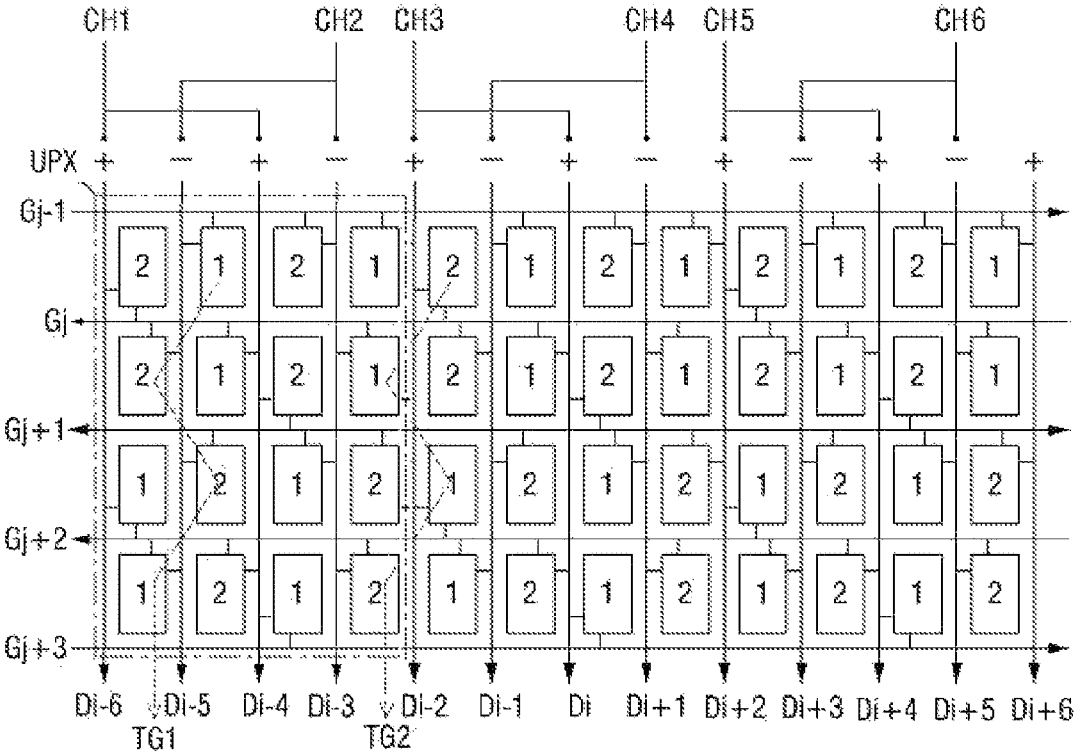
FIG. 9 illustrates the turn-on timing of each pixel of an alternative exemplary embodiment of an LCD according to the invention.
Figure 10:
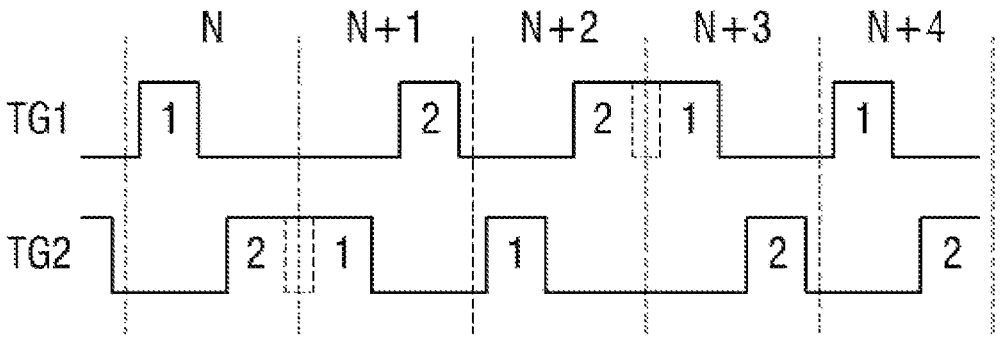
FIG. 10 is a timing diagram illustrating the driving order of an alternative exemplary embodiment of the LCD according to the invention.

FIG. 9 illustrates the turn-on timing of each pixel of another alternative exemplary embodiment of an LCD according to the invention. FIG. 10 is a timing diagram illustrating the driving order of the LCD of FIG. 9. FIG. 11 illustrates the luminance-based pixel arrangement of the LCD of FIG. 9.

Referring to FIG. 9, in an exemplary embodiment, data signals provided by a data driver 300 may be transmitted to a line selector 400 via a plurality of channels CH1, CH2, CH3, . . . , and the line selector 400 may provide the data signals to individual data lines D1 through Dm.

In such an embodiment, an LCD panel 100 may include unit pixels UPX, each defined by a plurality of pixels. A unit pixel UPX may include data lines branching or extending from a first channel CH1 and a second channel CH. A positive voltage may be applied to the first channel CH1, and a negative voltage may be applied to the second channel CH2.

In such an embodiment, data voltages may be applied to individual pixels at different times based on a first turn-on voltage 1 or a second turn-on voltage 2 in response to first and second selection control signals TG1 and TG2 provided by the line selector 400. In such an embodiment, the line selector 400 may be substantially the same as the line selector shown in FIG. 3. In such an embodiment, the first and fourth select transistors T11 and T22 may receive the same selection control signal, e.g., the second control signal TG2 shown in FIG. 10, and the second and third select transistors T12 and T21 may receive the same selection control signal, e.g., the first control signal TG1.

Pixels PX located at the same position in individual unit pixels UPX may have the same polarity, and the pixels PX located at the same position in individual unit pixels UPX may receive data voltages based on a same one of the first turn-on voltage 1 and the second turn-on voltage 2. However, data signals transmitted through individual channels may be different from each other.

In an exemplary embodiment, each pixel PX in a row may be connected to a right or left data line. In such an embodiment, each pixel PX in a column may be alternately connected to a right data line and a left data line, or each group of pixels PX in a column may be alternately connected to a right data line and a left data line. In such an embodiment, each group of pixels PX in a column may be defined by a plurality of adjacent pixels in the column.

Each pixel PX in a row may be connected to an upper gate line (e.g., a gate line disposed above the row) or a lower gate line (e.g., a gate line disposed below the row), and each pixel PX in a column may be connected to the upper or lower gate line. Referring to FIG. 9, in an exemplary embodiment, pixels located in an even-numbered column may be connected to a gate line disposed thereabove, and each pair of pixels located in an odd-numbered column may be connected to a gate line interposed therebetween. Connection of pixels to a gate line (e.g., Gj, Gj+2) may be determined in view of a data voltage applied to each individual pixel to reduce a luminance difference between the individual pixels.

In an exemplary embodiment, where the LCD has a demultiplexer structure, in which a difference in charging rate may occur, the second and first selection control signals TG2 and TG1 may be sequentially transmitted to pixels of a unit pixel column, starting with a pixel located on the left side of the unit pixel column. The second and first selection control signals TG2 and TG1 may be alternately transmitted in the same order to each unit pixel column.

In an exemplary embodiment, a $(i-5)^{th}$ data line Di−5 is connected to the third select transistor T21 to which the first selection control signal TG1 is transmitted. In such an embodiment, when a signal transmitted to a first gate line in FIG. 9, that is, a $(j-1)^{th}$ gate line Gj−1, has a high level, the first turn-on voltage 1 is applied to the $(i-5)^{th}$ data line Di−5. Therefore, a pixel connected to the $(i-5)^{th}$ data line Di−5 and the first gate line Gj−1 may display an image corresponding to a data voltage applied thereto based on the first turn-on voltage 1. While a signal transmitted to a second gate line in FIG. 9, that is, a $j^{th}$ gate line Gj has a high level, the second turn-on voltage 2 is applied to the third select transistor T21 connected to the $(i-5)^{th}$ data line Di−5. Therefore, a pixel connected to the $(i-5)^{th}$ data line Di−5 and the second gate line Gj may display an image corresponding to a data voltage applied thereto based on the second turn-on voltage 2. A turn-on voltage applied to the third select transistor T21 connected to the $(i-5)^{th}$ data line Di−5 in response to a signal transmitted to a third gate line in FIG. 9, that is, the $(j+1)^{th}$ gate line Gj+1, is the same as a turn-on voltage applied to the third select transistor T21 connected to the $(i-5)^{th}$ data line Di−5 in response to the signal transmitted to the second gate line Gj, as shown in FIG. 10. Therefore, a data signal may be provided to an individual pixel connected to the third gate line Gj+1 in the same way that a data signal is provided to the pixel connected to the second gate line Gj.

In an exemplary embodiment, a $(i-2)^{th}$ data line Di−2 is connected to the first select transistor T11 to which the second selection control signal TG2 is transmitted. In such an embodiment, when a signal transmitted to the first gate line Gj−1 has a high level, the second turn-on voltage 2 is applied to the $(i-2)^{th}$ data line Di−2. Therefore, a pixel connected to the $(i-2)^{th}$ data line Di−2 and the first gate line Gj−1 may display an image corresponding to a data voltage applied thereto based on the second turn-on voltage 2. When a signal transmitted to the second gate line Gj has a high level, the first turn-on voltage 1 is applied to the first select transistor T11 connected to the $(i-2)^{th}$ data line Di−2. Therefore, a pixel connected to the $(i-2)^{th}$ data line Di−2 and the second gate line Gj may display an image corresponding to a data voltage applied thereto based on the first turn-on voltage 1. A turn-on voltage applied to the first select transistor T11 connected to the $(i-2)^{th}$ data line Di−2 in response to a signal transmitted to the second gate line Gj is the same as a turn-on voltage applied to the first select transistor T11 connected to the $(i-2)^{th}$ data line Di−2 in response to the signal transmitted to the first gate line Gj−1, as shown in FIG. 10. Therefore, a data signal may be provided to an individual pixel connected to the third gate line Gj+1 in the same way that a data signal is provided to the pixel connected to the second gate line Gj.

The way that data signals are transmitted is not limited to the way described above, and the data signals may be transmitted in various ways in order to reduce a luminance difference between the individual pixels.

Referring to FIG. 10, in an exemplary embodiment, the first and second selection control signals TG1 and TG2 may have a high-level voltage at different times. In such an embodiment, scan signals may sequentially have a high-level voltage as shown in FIG. 4.

Each of the first and second selection control signals TG1 and TG2 may have a high-level voltage (a gate-on voltage Von) in each horizontal period 1H of a scan signal. The duration of the gate-on voltage Von of each of the first and second selection control signals TG1 and TG2 may be a half or less than a half of one horizontal time period 1H of the scan signal.

The first selection control signal TG1 has the first turn-on voltage 1 in a first horizontal section N, the second turn-on voltage 2 in a second horizontal section N+1, the second turn-on voltage 2 in a third horizontal section N+2, and the first turn-on voltage 1 in a fourth horizontal section N+3. In such an embodiment, the first selection control signal TG1 is repeated every four horizontal periods, such that the period of the first selection control signal TG1 is 4H.

The second selection control signal TG2 has the second turn-on voltage 2 in the first horizontal section N, the first turn-on voltage 1 in the second horizontal section N+1, the first turn-on voltage 1 in the third horizontal section N+2, and the second turn-on voltage 2 in the fourth horizontal section N+3. In such an embodiment, the second selection control signal TG2 is also repeated every four horizontal periods, such that the period of the second selection control signal TG2 is 4H.

Referring to FIG. 11, four types of luminance may be generated, that is, the luminance when a pixel receives a data voltage having a positive voltage in response to the first turn-on voltage 1, the luminance when a pixel receives a data voltage having the positive voltage in response to the second turn-on voltage 2, the luminance when a pixel receives a data voltage having a negative voltage in response to the first turn-on voltage 1, and the luminance when a pixel receives a data voltage having the negative voltage in response to the second turn-on voltage 2.

In an exemplary embodiment, as shown in FIG. 11, individual pixels having four different types of luminance are substantially evenly distributed over an LCD panel 100. Accordingly, a stripe defect that may occur when pixels having the same luminance are repeatedly arranged in the same column or in adjacent columns may be effectively prevented or substantially reduced in an exemplary embodiment where pixels are arranged based on luminance as illustrated in FIG. 11.

Figure 12:
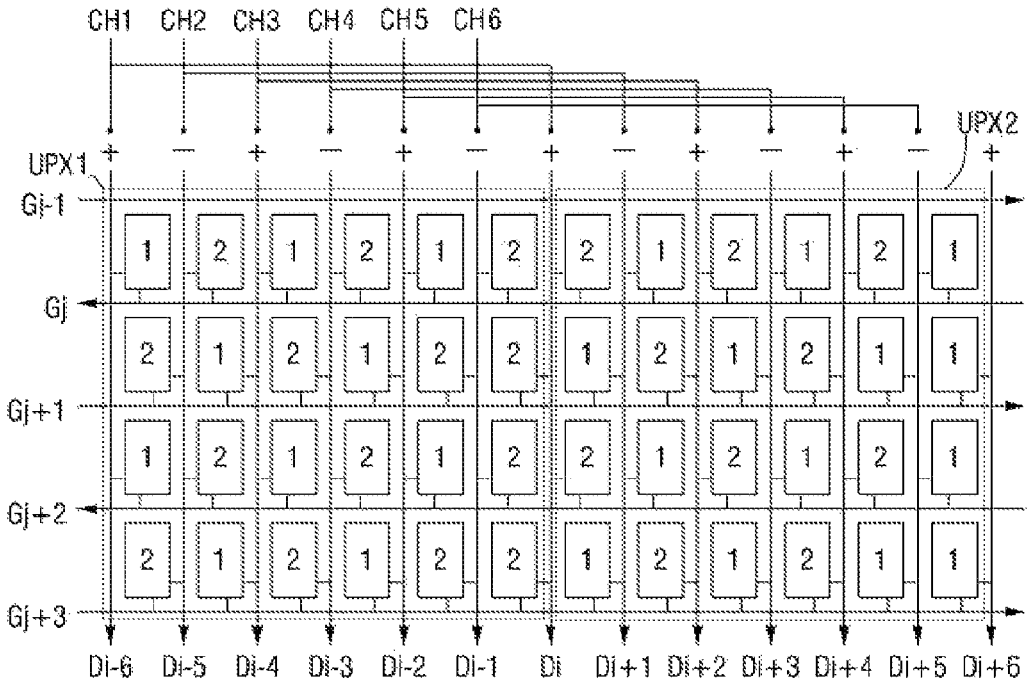
FIGS. 12 through 14 illustrate the pixel arrangements of exemplary embodiments of the LCD according to the invention.
Figure 13:
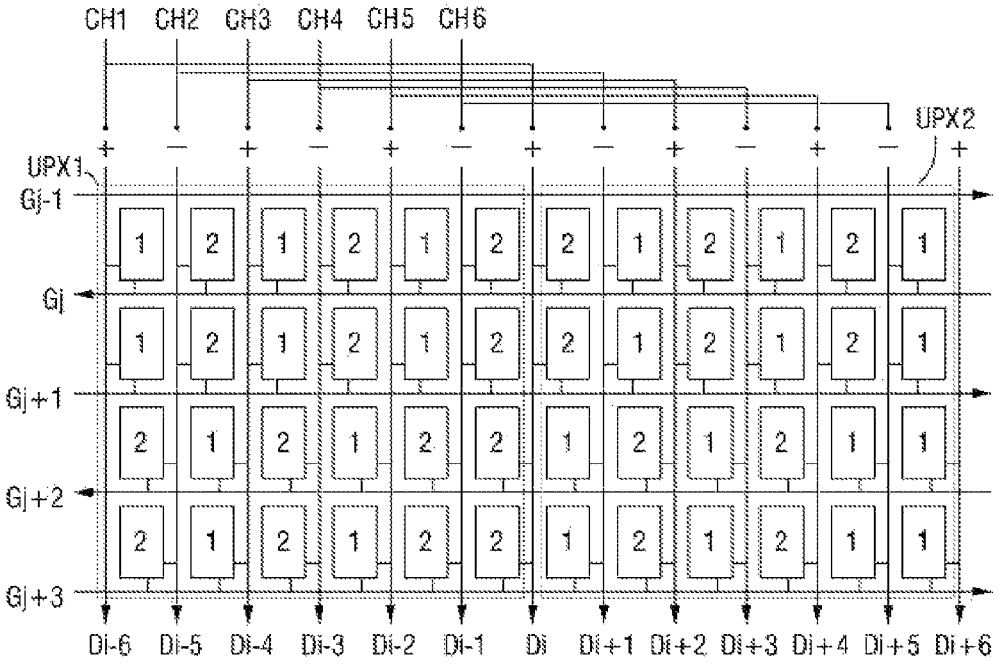
Figure 14:
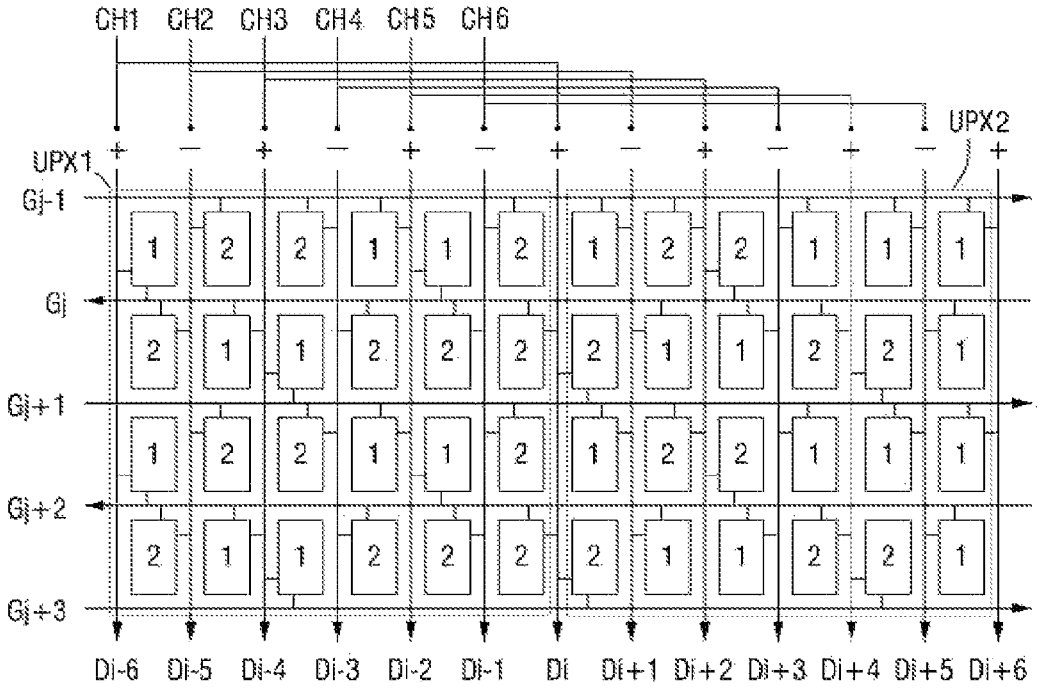

FIGS. 12 through 14 illustrate the pixel arrangements of alternative exemplary embodiments of the LCD according to the invention.

Referring to FIG. 12, in an exemplary embodiment, data signals provided by a data driver 300 may be transmitted to a line selector 400 via a plurality of channels CH1 through CH6, and the line selector 400 may provide the data signals to individual data lines D1 through Dm.

In such an embodiment, an LCD panel 100 may include unit pixels UPX, each having a plurality of pixels. A unit pixel UPX may include a plurality of data lines Di−6 through Di−1, which branch from first through sixth channels CH1 through CH6 and provide data signals in response to a first selection control signal TG1. A positive voltage may be applied to the odd-numbered channels CH1, CH3 and CH5, and a negative voltage may be applied to the even-numbered channels CH2, CH4 and CH6. Data signals transmitted to the first through sixth channels CH1 through CH6 may be different from each other.

In such an embodiment, a first type data voltage 1 or a second type data voltage 2 may be applied to individual pixels at different times in response to the first and second selection control signals TG1 and TG2 provided by the line selector 400. Herein, the first type data voltage 1 may refer to a data voltage applied during a first half of a horizontal period, and the second type data voltage 2 may refer to a data voltage applied during a second half of a horizontal period. The line selector 400 transmits the first selection control signal TG1 and the second selection control signal TG2 respectively to transistors connected to two data lines branching from each channel, such that the same data signal may be provided to the two data lines at different times.

Pixels PX located at the same position in individual unit pixels UPX may have the same polarity and may receive different types of data voltage (e.g., a first pixel in a first unit pixel UPX1 receives the first type data voltage 1, while the first pixel in a second unit pixel UPX2 receives the second type data voltage 2, as shown in FIG. 12).

In such an embodiment, each unit pixel UPX may include six data lines. In such an embodiment, data lines located at the same position in the first unit pixel UPX1 and the second unit pixel UPX2 adjacent to the first unit pixel UPX1 may branch from the same channel. In one exemplary embodiment, for example, a first data line of the first unit pixel UPX1 shown in FIG. 12, that is, the $(i-6)^{th}$ data line Di−6, and a first data line of the second unit pixel UPX2 shown in FIG. 12, that is, the $i^{th}$ data line Di, branch from the first channel CH1. While the first data line Di−6 of the first unit pixel UPX1 and the first data line Di of the second unit pixel UPX2 receive the same data signal, the first data line Di−6 of the first unit pixel UPX1 and the first data line Di of the second unit pixel UPX2 may receive the data voltage at different times in response to the first selection control signal TG1 and the second selection control signal TG2.

For ease of description, only a portion of the data lines and the gate lines are illustrated in FIG. 12. In such an embodiment, the data driver 300 performs column inversion as represented by polarities shown above the data lines. In such an embodiment, to perform the column inversion, a positive voltage and a negative voltage may alternate, or the same polarity may be repeated twice as described above.

A row of pixels PX may be connected to a right or left data line, and a column of pixels PX may be alternately connected to a right data line and a left data line. In one exemplary embodiment, for example, two polarities of a data voltage may alternate in the sequence of '+, −, +, −, +, −, . . . '. Therefore, in such an embodiment, a stripe defect that may occur when a column of pixels PX have the same polarity may be effectively prevented.

In an exemplary embodiment, where the LCD includes a demultiplexer structure in which a difference in charging rate may occur, the first and second selection control signals TG1 and TG2 may be transmitted to two data lines branching from each individual channel.

In an exemplary embodiment, a data signal may be transmitted to the first data line Di−6, which branches from the first channel CH1 and is in the first unit pixel UPX1, in response to the first selection control signal TG1, and a data signal may be transmitted to the first data line Di, which branches from the first channel CH1 and is in the second unit pixel UPX2, in response to the second selection control signal TG2.

In such an embodiment, a data signal may be transmitted to the second data line Di−5, which branches from the second channel CH2 and is in the first unit pixel UPX1, in response to the second selection control signal TG2, and a data signal may be transmitted to the second data line Di+1, which branches from the second channel CH2 and is in the second unit pixel UPX2, in response to the first selection control signal TG1.

In such an embodiment, a data signal may be transmitted to the third data line Di−4, which branches from the third channel CH3 and is in the first unit pixel UPX1, in response to the first selection control signal TG1, and a data signal may be transmitted to the third data line Di+2, which branches from the third channel CH3 and is in the second unit pixel UPX2, in response to the second selection control signal TG2.

In such an embodiment, a data signal may be transmitted to the fourth data line Di−3, which branches from the fourth channel CH4 and is in the first unit pixel UPX1, in response to the second selection control signal TG2, and a data signal may be transmitted to the fourth data line Di+3, which branches from the fourth channel CH4 and is in the second unit pixel UPX2, in response to the first selection control signal TG1.

In such an embodiment, a data signal may be transmitted to the fifth data line Di−2, which branches from the fifth channel CH5 and is in the first unit pixel UPX1, in response to the first selection control signal TG1, and a data signal may be transmitted to the fifth data line Di+4, which branches from the fifth channel CH5 and is in the second unit pixel UPX2, in response to the second selection control signal TG2.

In such an embodiment, a data signal may be transmitted to the sixth data line Di−1, which branches from the sixth channel CH6 and is in the first unit pixel UPX1, in response to the second selection control signal TG2, and a data signal may be transmitted to the sixth data line Di+5, which branches from the sixth channel CH6 and is in the second unit pixel UPX2, in response to the first selection control signal TG1.

In an exemplary embodiment, as described above, a unit pixel UPX may include six pixels and six data lines. However, the invention is not limited thereto, and a unit pixel UPX may include a plurality of pixels and a plurality of data lines in an alternative exemplary embodiment.

The pixel arrangement of the LCD shown in FIG. 13 is substantially the same as the pixel arrangement of the LCD of FIG. 12, and any repetitive detailed description thereof will be omitted.

In another alternative exemplary embodiment, referring to FIG. 13, a data driver 300 performs column inversion as represented by polarities shown in FIG. 13 above data lines. In such an embodiment, to perform the column inversion, a positive voltage and a negative voltage may alternate, or the same polarity may be repeated twice as described above.

A row of pixels PX may be connected to a right or left data line, and each group of pixels PX in a column may be alternately connected to a right data line and a left data line. In one exemplary embodiment, for example, the same polarity may be repeated twice and then inverted to have a polarity sequence of '+, +, −, −, +, +, −, −, +, +, . . . '.

In an exemplary embodiment, a unit pixel row may be defined by a predetermined number of pixel rows, that is, a predetermined number of gate lines and the pixels connected thereto. In an exemplary embodiment, a pixel row included in an LCD panel 100 and another pixel row adjacent to the pixel row in a column direction may define the unit pixel row. A unit pixel row may refer to a bundle of two adjacent pixel rows. However, the invention is not limited thereto, and three or more bundles of pixel rows may be defined as a unit pixel row.

Each pixel PX included in a unit pixel row may be connected to a data line located in the same direction. In one exemplary embodiment, for example, individual pixels PX of a first unit pixel row may be connected to a data line located on the left side thereof, and individual pixels PX of a second unit pixel row may be connected to a data line located on the right side thereof. The first unit pixel row and the second unit pixel row may be arranged alternately, and the same polarity may be repeated twice and then inverted to have a polarity sequence of '+, +, −, −, +, +, −, −, +, +, . . . '. Therefore, in such an embodiment, a stripe defect that may occur when a column of pixels PX have the same polarity may be effectively prevented.

In an exemplary embodiment, where the LCD has a demultiplexer structure in which a difference in charging rate may occur, first and second selection control signals TG1 and TG2 may be transmitted to two data lines branching from each individual channel.

In such an embodiment, a data signal may be transmitted to a first data line Di−6, which branches from a first channel CH1 and is in a first unit pixel UPX1, in response to the first selection control signal TG1, and a data signal may be transmitted to a first data line Di, which branches from the first channel CH1 and is in a second unit pixel UPX2, in response to the second selection control signal TG2.

In such an embodiment, a data signal may be transmitted to a second data line Di−5, which branches from a second channel CH2 and is in the first unit pixel UPX1, in response to the second selection control signal TG2, and a data signal may be transmitted to a second data line Di+1, which branches from the second channel CH2 and is in the second unit pixel UPX2, in response to the first selection control signal TG1.

In such an embodiment, third and fifth channels CH3 and CH5 may be arranged in a similar structure to the first channel CH1, and fourth and sixth channels CH4 and CH6 may be arranged in a similar structure to the first channel CH1. Therefore, any repetitive detailed description of the third through sixth channels CH3 through CH6 will be omitted.

In an exemplary embodiment, as described above, a unit pixel UPX may include six pixels and six data lines. However, the invention is not limited thereto, and a unit pixel UPX may include a plurality of pixels and a plurality of data lines in an alternative exemplary embodiment.

The pixel arrangement of the LCD of FIG. 14 is substantially the same as the pixel arrangement of the LCD of FIG. 12, and any repetitive detailed description thereof will be omitted.

Referring to FIG. 14, in another alternative exemplary embodiment, a data driver 300 performs column inversion as represented by polarities shown in FIG. 14 above data lines. In such an embodiment, to perform column inversion, a positive voltage and a negative voltage may alternate, or the same polarity may be repeated twice.

Each pixel PX in a row may be connected to a right or left data line, and each pixel PX in a column may be alternately connected to a right data line and a left data line. In one exemplary embodiment, for example, two polarities of a data voltage may alternate to have a polarity sequence of '+, −, +, −, +, −, . . . '. Therefore, in an exemplary embodiment, a stripe defect, which may occur when a column of pixels PX having the same polarity, is effectively prevented.

Each pixel PX in a row may be connected to a right or left data line, and each pixel PX in a column may be alternately connected to a right data line and a left data line, or each group of pixels PX in a column may alternately be connected to a right data line and a left data line.

Each pixel PX in a row may be connected to an upper or lower gate line, and each pixel PX in a column may be connected to an upper or lower gate line. Referring to FIG. 14, pixels located in an even-numbered column may be connected to a gate line disposed thereabove, and each pair of pixels located in an odd-numbered column may be connected to a gate line interposed between them. Connections of the pixels to a gate line (Gj, Gj+2) may be determined in view of a data voltage applied to each individual pixel to reduce a luminance difference between the individual pixels.

In an exemplary embodiment, where the LCD has a demultiplexer structure in which a difference in charging rate may occur, second and first selection control signals may be sequentially transmitted to pixels of a unit pixel column, starting with a pixel located on a left side of the unit pixel column. The second and first selection control signals may be alternately transmitted in the same order to each unit pixel column.

In exemplary embodiments set forth herein, pixels having different luminances are substantially evenly arranged such that a stripe defect is effectively prevented.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A display device comprising:

a plurality of pixels;

a plurality of gate lines extending substantially in a first direction;

a plurality of data lines extending substantially in a second direction and comprising a first through fourth data lines;

first channels which transmit data signals to the first and third data lines;

second channels which transmit data signals to the second and fourth data lines;

first and second unit pixel rows, each defined by a predetermined number of gate lines and the pixels connected to the predetermined number of gate lines; and a line selector which connects the first and second channels to the first through fourth data lines and provides data voltages respectively to the first through fourth data lines in response to a plurality of control signals, wherein each pixel in the first unit pixel row is connected to a data line located at a side thereof, each pixel in the second unit pixel row is connected to a data line located at the other side thereof, and a data voltage applied to the first channel has a different polarity from a data voltage applied to the second channel, wherein the line selector comprises:

a first select transistor is electrically connected between the first data line and the first channel, a second select transistor is electrically connected between the second data line and the second channel, a third select transistor is electrically connected between the third data line and the first channel, a fourth select transistor is electrically connected between the fourth data line and the second channel, wherein the control signals comprise a first selection control signal, a second selection control signal, a third selection control signal and a fourth selection control signal, the first channel is connected to the first data line and the third data line, and the second channel is connected to the second data line and the fourth data line, wherein the line selector further comprises:

a first select transistor which applies a data voltage to the first data line in response to the first selection control signal;

a second select transistor which applies a data voltage to the second data line in response to the second selection control signal;

a third select transistor which applies a data voltage to the third data line in response to the third selection control signal; and a fourth select transistor which applies a data voltage to the fourth data line in response to the fourth selection control signal, and wherein the duration of a gate-on voltage of each of the first selection control signal, the second selection control signal, the third selection control signal and the fourth selection control signal is equal to or less than a half of one horizontal time period of a scan signal, and each of the first selection control signal, the second selection control signal, the third selection control signal and the fourth selection control signal has one of a first gate-on voltage and a second gate-on voltage during each horizontal period of the scan signal, wherein the first gate-on voltage is in a first half of a horizontal period of the scan signal, and the second gate-on voltage is in a second half, which is after the first half, of the horizontal period of the scan signal.

2. The display device of claim 1, wherein a period of each of the first selection control signal and the second selection control signal is four horizontal periods of the scan signal, and a period of each of the third selection control signal and the fourth selection control signal is two horizontal periods of the scan signal.

3. The display device of claim 1, wherein each of the first unit pixel row and the second unit pixel row is defined by two gate lines.

4. The display device of claim 1, wherein a data voltage applied to the first channel has a different polarity from a data voltage applied to the second channel, and the polarity of a data voltage applied to each of the first channel and the second channel is inverted every predetermined time period.

5. A display device comprising:

a plurality of pixels arranged substantially in a matrix form;

a plurality of gate lines extending substantially in a first direction;

a plurality of data lines extending substantially in a second direction;

first and second unit pixel columns, each defined by a predetermined number of data lines and the pixels connected to the predetermined number of data lines;

first and second channels which transmit data signals to each of the first and second unit pixel columns; and a line selector which connects the first and second channels to the data lines of the first and second unit pixel columns and provides data voltages corresponding to pixel data respectively to the data lines of the first and second unit pixel columns in response to a plurality of control signals, which enables each pixel connected to a corresponding data line of the predetermined number of data lines to display a normal display, wherein a pixel connected to a first gate line is connected to a data line located at a side thereof, a pixel connected to a second gate line is connected to a data line located at the other side thereof, each of the first channel and the second channel is connected to a data line of each of the first unit pixel column and the second unit pixel column, each of the first unit pixel column and the second unit pixel column is defined by six data lines, the control signals comprise a first selection control signal and a second selection control signal, the first channel is connected to a first data line of the first unit pixel column and a first data line of the second unit pixel column, and the second channel is connected to a second data line of the first unit pixel column and a second data line of the second unit pixel column, wherein the line selector comprises:

a first select transistor which applies a data voltage to the first data line of the first unit pixel column in response to the first selection control signal;

a second select transistor which applies a data voltage to the second data line of the first unit pixel column in response to the second selection control signal;

a third select transistor which applies a data voltage to the first data line of the second unit pixel column in response to the second selection control signal; and a fourth select transistor which applies a data voltage to the second data line of the second unit pixel column in response to the first selection control signal, and wherein the duration of a gate-on voltage of each of the first selection control signal and the second selection control signal is equal to or less than a half of one horizontal time period of a scan signal, and each of the first selection control signal and the second selection control signal has one of a first gate-on voltage and a second gate-on voltage during each horizontal period, wherein the first gate-on voltage is in a first half of a horizontal period of the scan signal, and the second gate-on voltage is in a second half, which is after the first half, of the horizontal period of the scan signal.

6. The display device of claim 5, wherein a data voltage applied to the first channel has a different polarity from a data voltage applied to the second channel, and the polarity of a data voltage applied to each of the first channel and the second channel is inverted every predetermined time period.

7. A display device comprising:

a plurality of pixels arranged substantially in a matrix form;

a plurality of gate lines extending substantially in a first direction;

a plurality of data lines extending substantially in a second direction;

first and second unit pixel columns, each defined by a predetermined number of data lines and the pixels connected to the predetermined number of data lines;

first and second channels which transmit data signals to each of the first and second unit pixel columns;

first and second unit pixel rows, each defined by a predetermined number of gate lines and the pixels connected to the predetermined number of gate lines; and a line selector which connects the first and second channels to the data lines of the first and second unit pixel columns and provides data voltages corresponding to pixel data respectively to the data lines of the first and second unit pixel columns in response to a plurality of control signals, which enables each pixel connected to a corresponding data line of the predetermined number of data lines to display a normal display, wherein each pixel of the first unit pixel row is connected to a data line located at a side thereof, each pixel of the second unit pixel row is connected to a data line located at the other side thereof, and each of the first channel and the second channel is connected to a data line of each of the first unit pixel column and the second unit pixel column, each of the first unit pixel column and the second unit pixel column is defined by six data lines, wherein the line selector comprises:

a first select transistor which applies a data voltage to the first data line of the first unit pixel column in response to the first selection control signal;

a second select transistor which applies a data voltage to the second data line of the first unit pixel column in response to the second selection control signal;

a third select transistor which applies a data voltage to the first data line of the second unit pixel column in response to the second selection control signal; and a fourth select transistor which applies a data voltage to the second data line of the second unit pixel column in response to the first selection control signal, and wherein the duration of a gate-on voltage of each of the first selection control signal and the second selection control signal is equal to or less than a half of one horizontal time period of a scan signal, and each of the first selection control signal and the second selection control signal has one of a first gate-on voltage and a second gate-on voltage during each horizontal period, wherein the first gate-on voltage is in a first half of a horizontal period of the scan signal, and the second gate-on voltage is in a second half, which is after the first half, of the horizontal period of the scan signal.

8. The display device of claim 7, wherein the control signals comprise a first selection control signal and a second selection control signal, the first channel is connected to a first data line of the first unit pixel column and a first data line of the second unit pixel column, and the second channel is connected to a second data line of the first unit pixel column and a second data line of the second unit pixel column.

9. The display device of claim 7, wherein a data voltage applied to the first channel has a different polarity from a data voltage applied to the second channel, and the polarity of a data voltage applied to each of the first channel and the second channel is inverted every predetermined time period.

* * * * *